US007207744B2

(12) United States Patent
Jones, IV. et al.

(10) Patent No.: US 7,207,744 B2
(45) Date of Patent: Apr. 24, 2007

(54) MATS FOR USE IN PAVED SURFACES

(75) Inventors: David R. Jones, IV., Tampa, FL (US); Gregory S. Helwig, Granville, OH (US); David C. Trumbore, LaGrange, IL (US)

(73) Assignee: Owens Corning Fiberglas Technology, Inc., Summit, IL (US)

( * ) Notice: Subject to any disclaimer, the term of this patent is extended or adjusted under 35 U.S.C. 154(b) by 0 days.

(21) Appl. No.: 10/667,252

(22) Filed: Sep. 19, 2003

(65) Prior Publication Data

US 2004/0120765 A1 Jun. 24, 2004

Related U.S. Application Data

(63) Continuation-in-part of application No. 10/188,447, filed on Jul. 3, 2002, now Pat. No. 7,059,800, and a continuation-in-part of application No. 09/795,774, filed on Feb. 28, 2001, now Pat. No. 6,648,547.

(51) Int. Cl.
*E01C 3/06* (2006.01)

(52) U.S. Cl. ..... 404/75; 404/82

(58) Field of Classification Search ..... 404/31, 404/17–18, 76, 75, 82, 28, 27, 32, 72; 442/381
See application file for complete search history.

(56) References Cited

U.S. PATENT DOCUMENTS

| | | | |
|---|---|---|---|
| 2,115,667 | A | 4/1938 | Ellis |
| 3,311,035 | A | 3/1967 | Poskey et al. |
| 3,557,671 | A | 1/1971 | Vaslloff |
| 3,932,051 | A | 1/1976 | Cleary |
| 4,074,948 | A | 2/1978 | Heater, Jr. |
| 4,151,025 | A | 4/1979 | Jacobs |
| 4,175,978 | A | 11/1979 | Marzocchi et al. |
| 4,319,854 | A | 3/1982 | Marzocchi |
| 4,362,780 | A | 12/1982 | Marzocchi et al. |
| 4,404,244 | A | 9/1983 | Springston |
| 4,508,770 | A | 4/1985 | Muncaster et al. |
| 4,522,875 | A | 6/1985 | Still, Jr. et al. |

(Continued)

FOREIGN PATENT DOCUMENTS

| | | |
|---|---|---|
| EP | 413295 | 2/1991 |

(Continued)

*Primary Examiner*—Raymond Addie
(74) *Attorney, Agent, or Firm*—Inger H. Eckert; James J. Dottavio

(57) ABSTRACT

A method of repairing a paved surface utilizes a nonwoven or woven fibrous mat made from fibers including polymer fibers, the polymer fibers having a melting point greater than about 320° F. (160° C.). The mat has a load-elongation behavior such that when the mat is subject to tensile stress, the mat achieves at least 90% of its ultimate load at an elongation not greater than 5% of the specimen length in the direction of applied stress. Another mat comprises a nonwoven or woven fibrous mat made from fibers selected from the group consisting of mineral fibers, polymer fibers, natural fibers, and mixtures thereof, and a rubbery binder. Another mat comprises a nonwoven or woven fibrous mat made from a blend of high melt polymer fibers having a melting point of at least 350° F. (177° C.) and low melt polymer fibers having a melting point of less than 350° F. (177° C.).

3 Claims, 3 Drawing Sheets

U.S. PATENT DOCUMENTS 4,540,311 A 9/1985 Leach
4,617,219 A 10/1986 Schupack
4,629,358 A 12/1986 Springston et al.
4,637,946 A 1/1987 Shah et al.
4,678,699 A 7/1987 Kritchevsky et al.
4,684,289 A * 8/1987 Gnesa ..... 404/75
4,699,542 A 10/1987 Shoesmith
4,749,625 A 6/1988 Obayashi et al.
4,793,731 A * 12/1988 Gnesa ..... 404/83
4,826,718 A 5/1989 Unsworth et al.
4,834,577 A 5/1989 Perfetti
4,856,930 A 8/1989 Denning
4,863,789 A 9/1989 Arai
4,885,659 A 12/1989 Nowell et al.
4,957,390 A 9/1990 Shoesmith
4,980,223 A 12/1990 Nakano et al.
4,996,095 A 2/1991 Behdorf et al.
5,026,609 A 6/1991 Jacob et al.
5,028,490 A 7/1991 Koskenmaki et al.
5,082,393 A 1/1992 Ringesten et al.
5,110,627 A 5/1992 Shoesmith et al.
5,124,198 A 6/1992 Koskenmaki et al.
5,174,228 A 12/1992 Grimnes
5,226,210 A 7/1993 Koskenmaki et al.
5,246,306 A 9/1993 Shoesmith et al.
5,260,128 A 11/1993 Ishii et al.
5,393,559 A 2/1995 Shoesmith et al.
5,468,546 A 11/1995 Loftus et al.
5,521,305 A 5/1996 Huber et al.
5,711,834 A 1/1998 Saito
5,827,430 A * 10/1998 Perry et al. ..... 210/497.01
5,836,715 A 11/1998 Hendrix et al.
5,869,412 A 2/1999 Yenni, Jr. et al.
5,869,413 A * 2/1999 Gallagher et al. ..... 442/381
5,941,656 A 8/1999 Sugiyama et al.
6,013,376 A 1/2000 Yenni, Jr.
6,043,169 A 3/2000 Jaffee
6,123,879 A 9/2000 Hendrix et al.
6,235,136 B1 5/2001 Kittson et al.
6,235,378 B1 5/2001 Lowder
6,398,899 B1 6/2002 Umezawa et al.
6,503,853 B1 1/2003 Kassner et al.
2002/0155289 A1 10/2002 Cistone et al.

FOREIGN PATENT DOCUMENTS

EP 1158098 11/2001
FR 2767543 8/1997
FR 2777577 4/1998
JP 406248609 9/1994
JP 406346405 12/1994
JP 408013408 1/1996
JP 408199072 8/1996
JP 2000027109 1/2000
JP 2001/234505 8/2001

* cited by examiner

MATS FOR USE IN PAVED SURFACES

CROSS-REFERENCE TO RELATED APPLICATIONS

The application is a continuation-in-part of U.S. application Ser. No. 09/795,774, filed Feb. 28, 2001 now U.S. Pat. No. 6,648,547 and a continuation-in-part of U.S. application Ser. No. 10/188,447, filed Jul. 3, 2002 now U.S. Pat No. 7,059,800.

TECHNICAL FIELD AND INDUSTRIAL APPLICABILITY OF THE INVENTION

The present invention is related generally to paved surfaces such as roads and parking lots, and more particularly to mats suitable for providing benefits to the paved surfaces.

BACKGROUND OF THE INVENTION

Paved surfaces such as roads and parking lots are commonly constructed with a top surface layer of asphalt paving material. Over a period of time, the paved surface usually deteriorates due to the effects of traffic, temperature cycles and other environmental causes. Cracks develop in the paved surface, and the cracks can spread and cause further deterioration. Water can penetrate the paved surface by flowing into the cracks, causing further damage.

Damaged paved surfaces are usually repaired by applying a new surface layer of paving material over the damaged portions or over the entire paved surface. After a paved surface having cracks is resurfaced, many times the new surface layer cracks directly over the cracks in the old surface. This is known as "reflective cracking". One way to address this problem is to make the new surface layer thicker, but this is not very effective.

Consequently, various materials and methods have been tried for waterproofing and for preventing or repairing cracks and other deterioration in paved surfaces. One commercial product (an example of which is Petromat® from BP Amoco) is a reinforcement mat constructed from nonwoven needle-punched polypropylene fibers. The polypropylene mat is applied over a tack coat of asphalt, and then a surface layer of paving material is applied over the mat. The paving material is heated prior to its application over the mat. Unfortunately, the polypropylene mat tends to melt and/or shrink when it is exposed to the hot paving material, which detracts from its ability to provide reinforcement and waterproofing. Additionally, if the tack coat is applied at too high a temperature, the polypropylene mat may likewise shrink or melt. Another commercial product is Mirapave 400®, a nonwoven heat-set polypropylene geotextile from Mirafi.

Some patents describe reinforcement materials and methods of reinforcing paved surfaces. For example, U.S. Pat. No. 2,115,667 to Ellis discloses reinforcing an asphalt road with a reinforcing agent made from woven glass. A woven reinforcement material is usually less porous than a nonwoven material. This impedes the ability of the asphalt to penetrate the reinforcement material to create a strong paved surface. A woven material is also usually more expensive to manufacture than a nonwoven material.

U.S. Pat. No. 6,235,136 to Kittson et al. discloses a water-resistant mastic membrane. The membrane comprises a carrier layer and a grid of glass fibers, both embedded in molten mastic material. The carrier layer is designed to provide only limited performance to the mastic membrane, and can be destroyed, or melted, by the molten mastic material. The membrane is bulky, having a thickness of 50 mm to 150 mm, and consists primarily of mastic material.

SUMMARY OF THE INVENTION

The present invention relates to a mat for use in a paved surface comprising a nonwoven or woven fibrous mat made from fibers including polymer fibers, the polymer fibers having a melting point greater than about 320° F. (160° C.). The mat has a load-elongation behavior such that when the mat is subject to tensile stress, the mat achieves at least 90% of its ultimate load at an elongation not greater than 5% of the specimen length in the direction of applied stress.

The invention also relates to a mat for use in a paved surface comprising a nonwoven or woven fibrous mat made from fibers selected from the group consisting of mineral fibers, polymer fibers, natural fibers, and mixtures thereof, and a rubbery binder comprising a polymer having a glass transition temperature of −30° C. to +40° C.

The invention also relates to a mat for use in a paved surface comprising a nonwoven or woven fibrous mat made from a blend of high melt polymer fibers having a melting point of at least 350° F. (177° C.) and low melt polymer fibers having a melting point of less than 350° F. (177° C.).

The invention also relates to a mat for use in a paved surface comprising a first layer attached to a second layer. The first layer comprises a nonwoven fibrous mat made from fibers selected from the group consisting of mineral fibers, polymer fibers, natural fibers, and mixtures thereof. The second layer comprises a woven glass fiber mat or grid.

The invention also relates to a mat for use in a paved surface comprising a nonwoven or woven fibrous mat made from fibers selected from the group consisting of mineral fibers, polymer fibers, natural fibers, and mixtures thereof, and a nonstick layer on a major surface of the mat. The nonstick layer comprises a polymer layer that melts when hot paving material is applied and a nonstick coating on the outer surface of the polymer layer.

The invention also relates to a method of preventing cracking in a paved surface, the method comprising applying to the paved surface a nonwoven or woven fibrous mat made from fibers including polymer fibers. The polymer fibers have a melting point greater than about 320° F. (160° C.). The mat has a load-elongation behavior such that when the mat is subject to tensile stress, the mat achieves at least 90% of its ultimate load at an elongation not greater than 5% of the specimen length in the direction of applied stress.

The invention also relates to a method of improving a paved surface comprising the steps of: applying a layer of liquefied asphalt on a surface; applying a mat over the liquefied asphalt, the mat comprising a nonwoven mat produced from fibers having a melting point above about 330° F. (177° C.) selected from the group consisting of mineral fibers, polymer fibers, and mixtures thereof, the liquefied asphalt penetrating and soaking the mat; and applying a layer of paving material over the mat.

The invention further relates to a method of producing a mat for use in a paved surface comprising contacting fibers selected from the group consisting of mineral fibers, polymer fibers, natural fibers, and mixtures thereof, with a meltable material in the form of finely ground particles or fibers, melting the material such that it surrounds the fibers, and then allowing the material to solidify to function as a binder for the mat.

Various advantages of this invention will become apparent to those skilled in the art from the following detailed description of the preferred embodiments, when read in light of the accompanying drawings.

DETAILED DESCRIPTION AND PREFERRED EMBODIMENTS OF THE INVENTION

The present invention relates to mats suitable for providing one or more benefits to paved surface such as a roads, parking lots, or other types of paved surfaces. The mats can be used in the construction of a new paved surface, in the rejuvenation of an existing paved surface, or to repair a crack, pothole or other defect in an existing paved surface. The benefit(s) provided by the mats may include waterproofing, reinforcement, and/or crack prevention.

Figure 1:
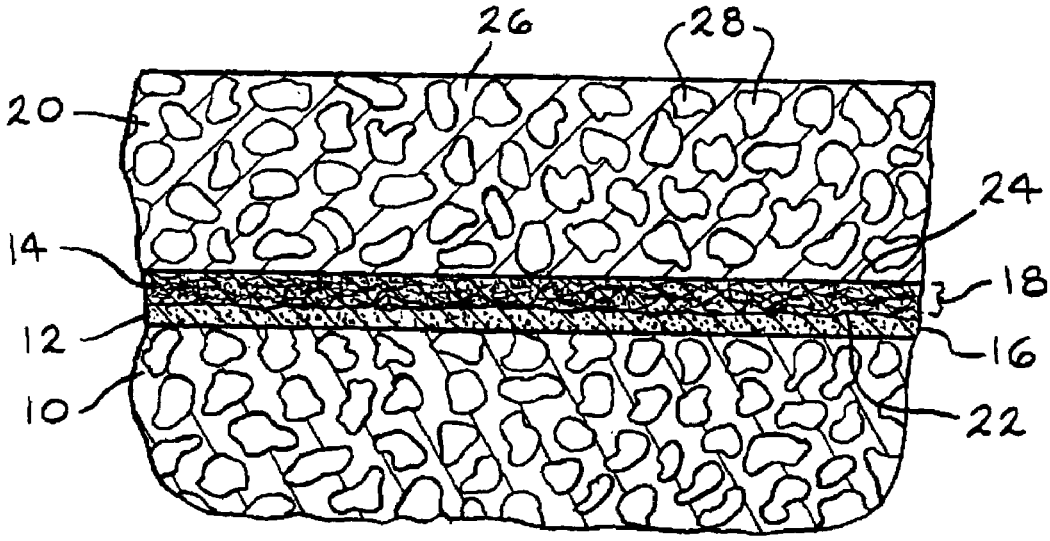
FIG. 1 is a cross-sectional view in elevation of a paved surface including a one-layer mat according to the invention.

Referring now to the drawings, FIG. 1 shows a paved surface 10 which is improved using a mat 14 according to the invention. The mat 14 can be applied on the paved surface 10 in any suitable manner. In one method, described below, a tack layer of liquefied asphalt 12 is first applied onto the paved surface 10, and then the mat 14 is applied onto the tack layer. However, other methods (not shown) of applying the mat can also be used. For example, a layer of adhesive can be applied to the paved surface and then the mat applied over the adhesive. Alternatively, a peel and stick adhesive can be applied to the mat and then the mat applied to the paved surface. In some methods, the mat may be sufficiently tacky for application to the paved surface without the use of a tack layer or adhesive. Alternatively, the mat may be laid and the liquified asphalt may be applied on top of the mat to saturate the mat.

In the embodiment shown in FIG. 1, a tack layer of liquefied asphalt 12 is initially applied on the paved surface 10. The liquefied asphalt 12 can be any type of bituminous material which is fluid at the time of application but which is able to firm up after application. For example, the liquefied asphalt can be a molten asphalt, e.g., asphalt heated to a temperature above about 250° F. [121° C.], an asphalt emulsion (asphalt dispersed in water with an emulsifier), or an asphalt cutback (asphalt diluted with a solvent to make the asphalt fluid). The liquefied asphalt can also include polymer-modified asphalt and asphalt containing a filler.

The layer of liquefied asphalt 12 can be applied in any amount which is suitable for penetrating and soaking the mat 14. Preferably, the liquefied asphalt is applied at a rate within a range of from about 0.1 gallon/square yard (0.32 liter/square meter) to about 0.5 gallon/square yard (1.58 liter/square meter), the optimum rate depending on the weight of the mat. The liquefied asphalt can be applied by any suitable method, such as by spraying it as a layer or by pouring and spreading it into a layer.

A mat 14 according to the invention is applied over the liquefied asphalt 12, while the liquefied asphalt is still in the fluid condition. In the embodiment shown in FIG. 1, the mat is a one-layer mat. The mat 14 is sufficiently porous such that the liquefied asphalt penetrates and soaks the mat. In the embodiment shown, the layer of liquefied asphalt 12 includes a bottom portion 16 below the mat 14 and a top portion 18 which saturates the mat. However, the liquefied asphalt could also be located entirely inside the mat after it is applied. Preferably, the mat can absorb at least about 0.1 gallon/square yard (0.32 liter/square meter) of the liquefied asphalt.

A sufficient amount of liquefied asphalt 12 is applied, and the mat 14 soaks up enough liquefied asphalt, to form a strong bond with the paved surface 10 and with the layer of paving material 20, described below. The mat preferably forms a water barrier that prevents water from penetrating into the paved surface from above. Preferably, the mat is substantially completely saturated with the liquefied asphalt, such that the liquefied asphalt penetrates from a bottom surface 22 to a top surface 24 of the mat 14.

The mat 14 is a nonwoven fibrous mat made from mineral fibers, polymer fibers, natural fibers, or mixtures thereof. The natural fibers can be polymeric or other naturally occurring fibrous materials having properties suitable for use in the invention, including organic felt. As used herein, "natural fibers" will refer to the non-polymer type of natural fibers, and "polymer fibers" will refer to both natural and synthetic polymeric fibers. The nonwoven mat is typically more porous and less expensive to manufacture than a woven mat. Preferably, the mat is not impregnated with any materials, such as asphalt, polymer or filler, prior to its application over the liquefied asphalt. However, a pre-impregnated mat can also be used.

Suitable mineral fibers for producing the mat include fibers of a heat-softenable mineral material, such as glass, rock, slag, or basalt. As used herein, "mineral fibers" can also include carbon fibers, and metal fibers such as fibers made from or coated with aluminum, copper, silver, iron or chromium, and may include metallicized polymeric fibers. Such fibers may be modified to provide desired electromagnetic properties, such as by the addition of Al, Cu, Ag, Fe, Cr and other conductive metals or metalicized polymers.

Preferably, the mineral fibers are glass fibers. Any suitable process can be used to produce the glass fibers. One such process is known as a rotary process, in which molten glass is placed into a rotating spinner which has orifices in the perimeter, wherein glass flows out the orifices to produce a downwardly falling stream of fibers which are collected on a conveyor. A second fiber forming process is a continuous process in which glass fibers are mechanically pulled from the orificed bottom wall of a feeder or bushing containing molten glass. Substantially contemporaneous with forming, the glass fibers are brought into contact with an applicator wherein a size is applied to the fibers. The sized glass fibers are then chopped to a specified length and packaged. Glass fibers made by these processes are commercially available from Owens Coming, Toledo, Ohio. In one embodiment, the mat is an OCMat 9003 glass mat commercially available from Owens Coming. This mat contains glass fibers that are 16 micron diameter E-glass type 9501. The mat contains 18% binder consisting of urea-formaldehyde resin and styrene-butadiene latex. Alternative glass mats can also be used.

Suitable polymer fibers for producing the mat can be formed from a fibrous or fiberizable material prepared from natural organic polymers, synthetic organic polymers or inorganic substances. Natural organic polymers include regenerated or derivative organic polymers. For example, the natural fibers can include cellulosic fibers such as flax, jute or wood pulp. Synthetic polymers include, but are not limited to, polyesters such as polyethylene terephthalate (PET), polyamides (e.g., nylons), polypropylenes, polyphenylenes such as polyphenylene sulfide (PPS), polyolefins, polyurethanes, polycarbonates, polystyrenes, acrylics, vinyl polymers, and derivatives and mixtures thereof.

The polymer fibers preferably have a melting point of at least about 330° F. (166° C.), more preferably at least about 350° F. (177° C.), more preferably at least about 375° F. (191° C.), and most preferably at least about 400° F. (204° C.). The use of the high melting point fibers forms a mat having not more than minimal melting or shrinking when it is exposed to hot paving material. It should not be a problem if some of the fibers do melt, so long as the overall mat retains its integrity.

One skilled in the art appreciates that the polymer fiber content of the mat may be varied to achieve the desired properties, and as such the content may include about 1% by weight to about 99% by weight polymer fibers. In one embodiment, the mat is made from a mixture of glass fibers and polymer fibers, and the amount of polymer fibers is not more than about 45% by weight of the total fibers.

Preferably, the polymer fibers include at least about 5% by weight polyester fibers, at least about 5% by weight nylon fibers, or at least about 5% by weight of a mixture of polyester fibers and nylon fibers. Nylon fibers are preferred for use in the mat because of their high melting point (509° F. [265° C.]). Nylon or PET fibers preferably have a denier within a range between about 1.5 dtex and about 12 dtex, and preferably have a cut length within a range between about 0.25 inch (0.64 cm) and about 2 inches (5.08 cm).

In another embodiment, the mat is made from a blend of high melt polymer fibers and low melt polymer fibers, and optionally also mineral fibers such as glass fibers. The "high melt" polymer fibers have a melting point of at least 350° F. (177° C.), and the "low melt" polymer fibers have a melting point of less than 350° F. (177° C.). Some nonlimiting examples of typical high melt polymers are polyamides such as nylon 6 and nylon 6,6, polyesters such as polyethylene terephthalate, certain types of natural fibers, and mixtures thereof. Some nonlimiting examples of typical low melt polymers are polyolefins such as polypropylene, different types of low melt copolymers, and mixtures thereof. A mat made with the blend of fibers is flexible and is resistant to shrinkage and melting. The mat can be made with a binder or some of the low melt fibers can double as the binder.

In a preferred embodiment of the invention, the polymer fibers are reclaimed fibers, scrap fibers, or mixtures thereof. The use of reclaimed or scrap fibers is economical and good for the environment. The reclaimed polymer fibers can be any type of reclaimed fibers suitable for producing a mat having the desired properties. In one embodiment, the reclaimed polymer fibers are reclaimed carpet fibers. It is estimated that up to 3 billion pounds (1.36 billion kilograms) of carpet are discarded every year in the United States alone. The carpet fibers can be made from any fiber-forming polymer suitable for textile applications, including, but not limited to, polyamides such as nylons (e.g., nylon 6, nylon 6,6, and nylon 6,12), polyesters, polypropylenes, polyethylenes, poly(trimethylene terephthalate), poly(ethylene terephthalate), ethylene-vinyl acetate copolymer, and acrylics. Non-limiting examples of useful polyamide fibers include nylon fibers such as are commercially available from E. I. duPont de Nemours and Company of Wilmington, Del., polyhexamethylene adipamide, polyamide-imides and aramids.

The scrap polymer fibers can be any type of scrap fibers suitable for producing a mat having the desired properties. The scrap fibers can be any consumer or industrial scrap fibers. In one embodiment, the scrap fibers are scrap carpet fibers, such as cut ends, bobbin ends, fibers generated from edge trimming, or fibers which do not meet manufacturing specifications.

In a preferred embodiment, the fibers used to produce the mat are a mixture of glass fibers and polymer fibers (each preferably having a melting point greater than about 320° F. [160° C.]), preferably greater than 325° F. (163° C.), and more preferably 330° F. (177° C.) or greater. The addition of the polymer fibers increases the flexibility, resilience and ease of handling of the mat, while the addition of the glass fibers increases the tensile strength and reduces the elongation of the mat. The combination produces a strong and flexible mat which is easy to handle.

For example, a preferred mat according to the invention is produced from a mixture of 70% by weight glass fibers and 30% by weight PET fibers. In a preferred embodiment, the glass fibers are 16 micron diameter E-glass type 9501, and the PET fibers have a denier between about 1.5 dtex and about 12 dtex and a cut length between about 0.25 inch (0.64 cm) and about 2 inches (5.08 cm). Such a mat weighing 4 ounces per square yard has the following physical properties:

| | | | Typical Value | |
|---|---|---|---|---|
| Property | Test method | Units | MD | CD |
| Grab tensile strength | ASTM D4632 | N (lb) | 300 (67) | 190 (44) |
| Grab tensile elongation | ASTM D4632 | % | 2.3 | 1.8 |
| Trapezoidal tear strength | ASTM D4532 | N (lb) | 24 (5.4) | 24 (5.4) |
| Mullen burst strength | ASTM D3786 | kPa (psi) | 485 (70) | |
| Melting point | ASTM D276 | ° C. (° F.) | >230 (>450) | |
| Asphalt absorption | Tex-616-J | $l/m^2$ ($gal/yd^2$) | 0.66 (0.21) | |
| Shrinkage | Tex-616-J | % | 0 | |
| Mass per unit area | ASTM D5261 | $g/m^2$ ($oz/yd^2$) | 136 (4.0) | |

In another preferred embodiment, the mat is made with polymer fibers having a melting point greater than about 320° F. (160° C.), and the mat has a desired load-elongation behavior: when the mat is subject to tensile stress, it achieves at least 90% of its ultimate (breaking) load at an elongation not greater than 5% of the specimen length in the direction of applied stress. Although any suitable test method can be used, typically the load-elongation is tested on a 2-inch (5.08 cm) wide specimen with a 7-inch (17.78 cm) length between the jaws and a rate of extension of 2 inches (5.08 cm)/minute, at room temperature. The mat can be made with 100% polymer fibers or with a mixture of polymer fibers, mineral fibers and/or natural fibers. Preferably, the polymer fibers have an even higher melting point as described above.

The mat preferably resists shrinkage when exposed to hot paving material. This contrasts with a mat made from polypropylene, which would have a significant amount of shrinkage. The resistance to shrinkage can be measured as follows: when a 4 ounce (113.4 gram) sample of the mat is held in an oven at 325° F. (163° C.) for one minute, the area of the mat is reduced to not less than about 90% of its original area, more preferably not less than about 95%, and most preferably the mat has substantially no loss of area.

In another embodiment, the mat is made of glass fibers. A glass fiber mat is thermally stable, and does not melt and/or shrink when it is exposed to hot paving material. The glass fiber mat has much higher tensile and mechanical strengths than the polypropylene mats typically used. Preferably, the glass fiber mat has a density within a range of from about 0.5 to about 10 pounds per hundred square feet (about 0.02 $kg/m^2$ to about 0.42 $kg/m^2$), and more preferably from about 1 to about 5 pounds per hundred square feet (about 0.04 $kg/m^2$ to about 0.21 $kg/m^2$). In a specific embodiment, the mat is a glass fiber mat suitable for use as a roll roofing product, except that it is not saturated with asphalt before application. For example, the mat may be wrapped in a continuous roll having a width within a range of from about 10 feet (3.05 meters) to about 20 feet (6.1 meters). The mat is applied over the liquefied asphalt by unrolling the mat from the roll onto the liquefied asphalt.

The mat of the invention can be produced by any suitable method which produces a nonwoven fibrous mat. Preferably, the mat is produced by a wet-laid process. In this process, a water slurry is provided into which the fibers are dispersed. The water slurry may contain surfactants, viscosity modifiers, defoaming agents, or other chemical agents. Chopped fibers are then introduced into the slurry and agitated such that the fibers become dispersed. The slurry containing the fibers is then deposited onto a moving screen, and a substantial portion of the water is removed to form a web. A binder is then applied, and the resulting mat is dried to remove the remaining water and to cure the binder. The resulting nonwoven mat consists of an assembly of substantially dispersed individual fibers. The nonwoven mat can also be produced by a dry-laid process. In this process, fibers are chopped and air blown onto a conveyor, and a binder is then applied to form the mat. Any suitable binder can be used, such as urea formaldehyde or an acrylic resin.

Alternatively, the binder can be applied by melting a material such that it surrounds the fibers, and then allowing the material to solidify so that it functions as a binder. Any suitable material can be used, such as a polymer that melts below about 310° F. (154° C.). Preferably, the material is in a form that will facilitate the melting, for example, in the form of fibers or finely ground particles. The binder can be applied onto the fibers and then the fibers/binder put through an oven to melt the binder. For example, a thermoplastic polymer such as SBS or polypropylene can be finely ground and used as a binder with fibers that melt at a temperature above about 320° F. (160° C.), e.g., glass fibers or a mixture of glass and high melting polymer fibers. Any suitable level of binder can be used, typically from about 5% to about 60% binder by weight of the mat.

In one embodiment, the mat is produced using a flexible or rubbery binder. Some nonlimiting examples of rubbery binders are styrene-butadiene rubber, styrene-butadiene-styrene rubber, acrylic copolymers such as methylmethacrylate/butyl acrylate, styrene acrylate, vinyl acetate/ethylene, vinyl chloride/ethylene, and other polymers having a glass transition temperature below about 20° C., preferably below about 0° C. The use of the rubbery binder improves the mat by making it tougher and more flexible. The rubbery binder can be used with any of the mineral, polymer or natural fibers described above. In one embodiment, a rubbery binder provides flexibility to a mat made with 100% mineral fibers. Regardless of the type of binder used, the mat preferably has the load-elongation behavior described above.

The nonwoven mat can also be produced without a binder using any of the methods known in the art. For example, the mat can be produced by needling, or by hydroentanglement or air entanglement. If the mat is made with bicomponent fibers including a polymer portion, often a binder is not required.

Figure 2:
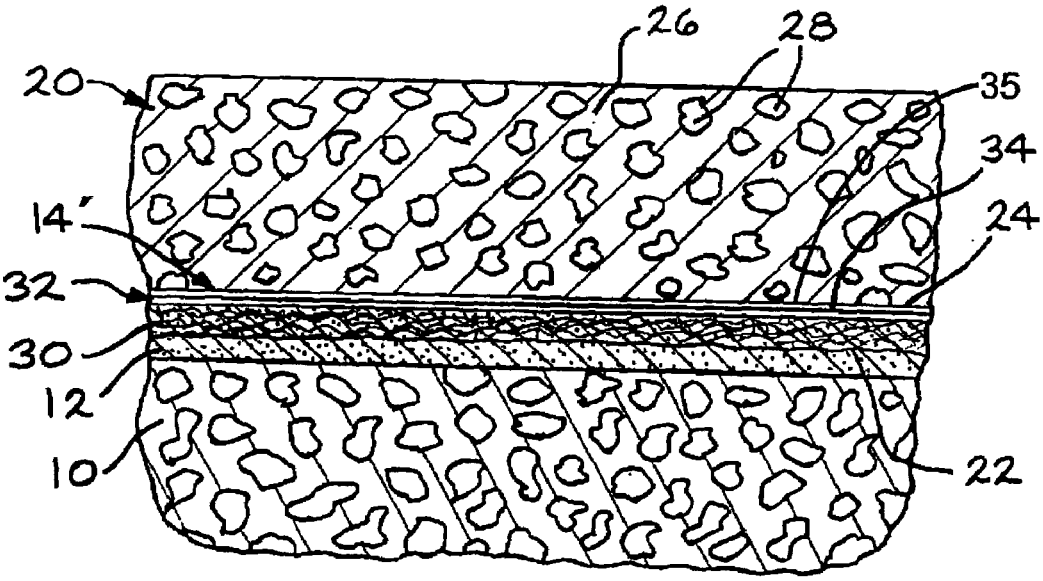
FIG. 2 is a cross-sectional view in elevation of a paved surface including a two-layer mat according to the invention.

FIG. 2 illustrates a paved surface including a two-layer mat 14' according to the invention. The mat 14' includes a first layer 30 and a second layer 32. The first layer 30 is a nonwoven or woven fibrous mat made from mineral fibers, polymer fibers, natural fibers, or mixtures thereof. Preferably, the first layer 30 is a nonwoven fibrous mat as described above in relation to the one-layer mat 14 shown in FIG. 1.

Figure 3:
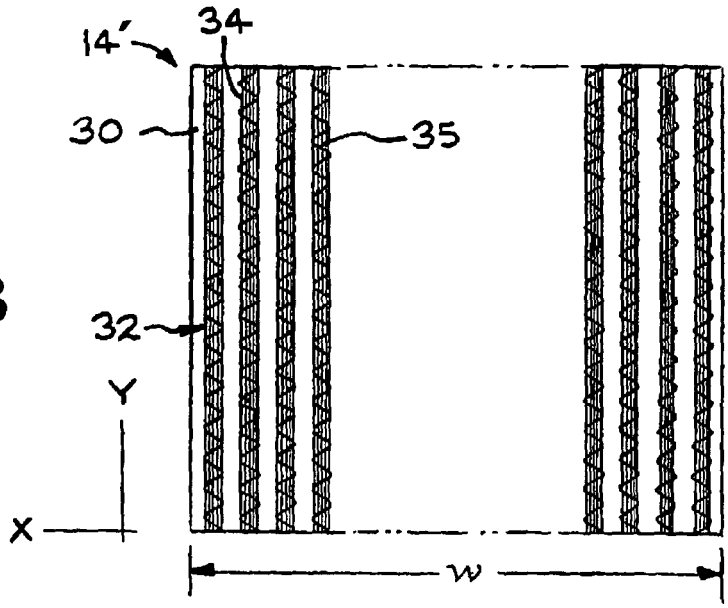
FIG. 3 is a plan view of a first embodiment of the two-layer mat illustrated in FIG. 2 showing a second layer of continuous strands of glass fiber.

In a first embodiment, shown in FIG. 3, the first layer 30 of the mat 14' is made of glass fibers, and has a width w. Such a glass fiber mat is thermally stable, and does not melt and/or shrink when it is exposed to hot paving material. At the levels of strain encountered in the movement of pavements, the glass fiber mat comprising the first layer 30 carries much higher tensile loads than the polypropylene mats typically used. Preferably, the glass fiber mat has a basis weight within a range of from about 0.5 to about 10 pounds per hundred square feet (about 0.02 $kg/m^2$ to about 0.42 $kg/m^2$), and more preferably from about 1 to about 5 pounds per hundred square feet (about 0.04 $kg/m^2$ to about 0.21 $kg/m^2$).

As shown in FIG. 3, the second layer 32 includes a plurality of continuous strands 34 of glass fibers disposed on a surface of the first layer 30. The strands 34 can be oriented in any desired direction relative to the first layer 30, and relative to one another. In the embodiment shown in FIG. 3, the strands 34 are oriented along the Y direction, and are substantially parallel to one another. In another embodiment (not shown), in addition to the strands oriented along the Y direction, the second layer also includes a plurality of strands oriented along the X direction.

Adjacent parallel strands 34 can be spaced at any desired distance relative to one another. Preferably, the strands 34 are spaced within the range of about 0.5 to about 12 strands per inch of width w (19.7 to 472 strands/meter of width w) of the first layer 30. More preferably, the strands 34 are spaced at about 2.0 strands per inch of width w (78.8 strands/meter of width w) of the first layer 30.

Each bundle 34 can contain any desired amount of filaments of glass fibers. The strands 34 preferably have a linear density within the range of from about 100 to about 1000 yards per pound (241 to 2411 meters/kilogram) of glass. More preferably, the strands 34 have a linear density within the range of from about 200 to about 450 yards per pound (482 to 1085 meters/kilogram) of glass. Additionally, the second layer 32 preferably weighs within the range of from about 0.5 to about 15 ounces per square yard (17 to 512 grams/square meter) of mat 14'. More preferably, the second layer 32 weighs within the range of from about 4.5 to about 6.5 ounces per square yard (153 to 220 grams/square meter) of mat 14'.

The strands 34 comprising the second layer 32 can be attached to the first layer 30 by any desired method. Knitting, as shown in FIG. 3, is a preferred method of attaching the strands 34 to the first layer 30. As used herein, knitting is defined as a method of attaching by interlacing yarn or thread 35 in a series of connected loops with needles. The strands 34 can also be attached to the first layer 30 by other methods, such as, for example, sewing, needling, heat treating, adhering with an adhesive, or any combination thereof. The thread 35 can be any desired natural or synthetic material. Preferably the thread 35 is synthetic. More preferably, the thread 35 is polyester or nylon because of the relatively high melting temperatures of both polyester and nylon. The thread preferably is made from a polymer having a melting point of at least about 350° F. (177° C.), more preferably at least about 400° F. (204° C.).

Figure 4:
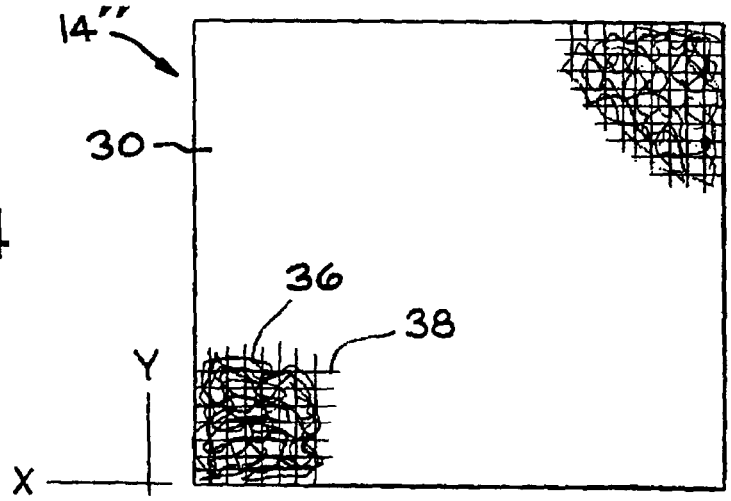
FIG. 4 is a plan view of a second embodiment of the two-layer mat illustrated in FIG. 2 showing a second layer of randomly-oriented continuous-strand glass fiber mat.

A second embodiment of the two-layer mat is generally shown at 14" in FIG. 4. The mat 14" includes the first layer 30, and a second layer 36. The second layer 36 is formed from a randomly-oriented continuous strand of glass fiber applied to a surface of the first layer 30 by any conventional method. The layer 36 formed from the continuous strand of glass fiber is commonly known as a continuous filament mat (CFM). The second layer 36 can have any desired weight. Preferably, the second layer 36 weighs within the range of from about 4.5 to about 45 ounces per square yard (154 to 1535 grams/square meter) of mat 14". More preferably, the second layer 36 weighs within the range of from about 9.0 to about 18 ounces per square yard (307 to 614 grams/square meter) of mat 14".

The second layer 36 can be attached to the first layer 30 by any desired method. Knitting is a preferred method of attaching the second layer 36 to the first layer 30, as described above for attaching the second layer 32 to the first layer 30. As shown in FIG. 4, threads 38 attach the second layer 36 to the first layer 30 in a series of connected loops.

Figure 5:
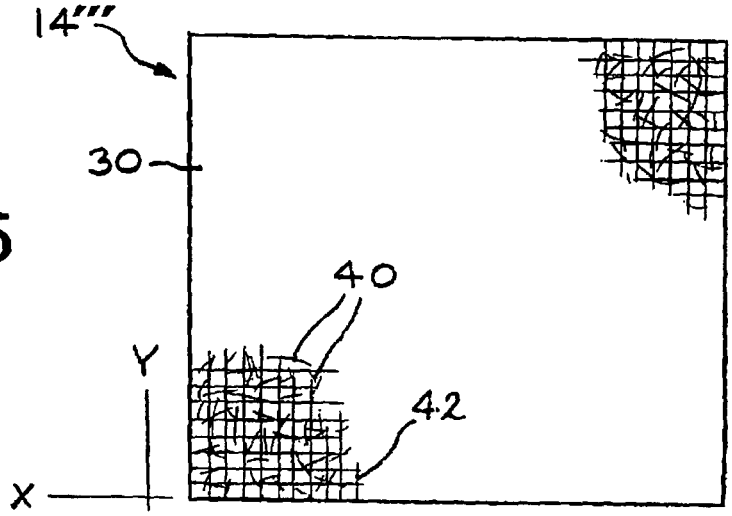
FIG. 5 is a plan view of a third embodiment of the two-layer mat illustrated in FIG. 2 showing a second layer of randomly-oriented chopped strands of glass fiber.

A third embodiment of the two-layer mat is generally shown at 14'" in FIG. 5. The mat 14'" includes the first layer 30, and a second layer 40. The second layer 40 is formed from randomly-oriented chopped strands of glass fiber applied to a surface of the first layer 30 by any conventional method. The random orientation of the chopped strands of the layer 40 provide improved strength to the mat 14'" in a first, x, dimension and a second, y, dimension. The second layer 40 can include chopped strands of any desired length. Preferably, the chopped strands have a length within the range of from about 0.5 to about 8.0 inches (0.013 to 0.20 meters). More preferably, the chopped stands have a length within the range of from about 2.0 to about 4.0 inches (0.05 to 0.1 meters). Most preferably, the chopped stands have a length of about 2.0 inches (0.05 meters).

The second layer 40 can have any desired weight. Preferably, the second layer 40 has a weight within the range of from about 0.5 to about 15 ounces per square yard (17 to 512 grams/square meter) of mat 14'". More preferably, the second layer 40 weighs within the range of from about 5.0 to about 8.0 ounces per square yard (171 to 273 grams/square meter) of mat 14'". The second layer 40 can be attached to the first layer 30 by any desired method. Knitting is a preferred method of attaching the second layer 40 to the first layer 30, as described above for attaching the second layer 32 and 36 to the first layer 30. As shown in FIG. 5, threads 42 attach the second layer 40 to the first layer 30 in a series of connected loops.

The second layer can also be a woven mat or grid (not shown) attached to the first layer, where the first layer is a nonwoven mat as described above. In a preferred embodiment, the second layer is a woven glass fiber mat or grid, and the first layer is a nonwoven mat made from glass and polymer fibers, most preferably polyethylene fibers. The woven mat or grid can be attached to the nonwoven mat in any suitable manner, for example, by stitching or gluing. The grid itself could be stitched or glued together and then attached to the mat, or formed in a series of operations onto the mat.

The one-layer mat 14 and the two-layer mat 14', 14" and 14'" can be wrapped in a continuous roll, although a continuous roll is not required. Preferably, such a continuous roll has a width within a range of from about 5 feet (1.52 meters) to about 20 feet (6.1 meters). The continuous roll may also have any desired width. The mat is applied by unrolling the mat from the roll onto the tack layer or directly onto the paved surface.

A mat according to the invention preferably meets the following minimum property requirements:

| Property | Test Methods | Units | Requirements |
|---|---|---|---|
| Breaking Strength, minimum | ASTM D5035-90 | N/50 mm | 200 |
| Ultimate elongation | ASTM D5035-90 | % | 5 |
| Mass per unit area, minimum | ASTM D5261 | $g/m^2$ | 125 |
| Asphalt retention | ASTM D6140 | l/m2 | Notes 2 and 3 |

Note 1:
All numeric values represent MARV in the weaker principal direction. (MARV: minimum average roll values, i.e., average test results of any roll in a lot sampled for conformance or quality assurance testing shall meet or exceed the minimum values provided therein.)
Note 2:
Asphalt required to saturate paving mat only.
Note 3:
Product asphalt retention property must meet the MARV value provided by the manufacturer certification.

Referring again to the embodiment shown in FIG. 1, the liquefied asphalt is allowed to become firm, or at least partially solidify, at some time after the application of the mat. Usually, the liquefied asphalt is allowed to become firm before the application of the paving material described below. For example, molten asphalt can be allowed to become firm by cooling, asphalt emulsion can be allowed to become firm by evaporation of water, and cutback asphalt can be allowed to become firm by evaporation of solvent. The open porosity of the one-layer mat 14, and of the first layer 30 of the two-layer mat 14', 14" and 14'", facilitates the evaporation of water or solvent.

A layer of paving material 20 is applied over the mat. The paving material 20 can be any material suitable for providing a top surface layer of a paved surface, such as an asphalt paving material, typically a mixture of asphalt 26 and aggregate 28, or a concrete paving material. The paving material is usually applied in a heated condition, and then allowed to cool. When the heated paving material is applied over the mat the heat of the mix partially liquefies the asphalt in the reinforcement layer, drawing it up into the mat, and forming a monolithic waterproof bond with the overlying pavement layer. It is during this heating step (that is unavoidable when placing an asphalt paving mixture over the mat) that damage from melting and shrinking can occur with polypropylene mats.

When the paved surface is completed, the penetration of the mat 14 by the liquefied asphalt 12 (now at least partially solidified) forms a strong bond between the mat, the asphalt, the paved surface, and the layer of paving material. This creates a strong, monolithic paved surface structure that is very resistant to damage. The high tensile and mechanical strength of the mat may provide mechanical reinforcement to the paved surface. Additionally, the penetration of the mat by the asphalt may form a water barrier or waterproof membrane that prevents water from penetrating into the paved surface from above and causing damage.

In another embodiment (not illustrated), a non-paved surface is paved by applying the liquefied asphalt on a prepared unpaved surface, applying the mat over the liquefied asphalt and the prepared unpaved surface, and applying the paving material over the mat. In some embodiments, the mat can be applied without first applying the liquefied asphalt.

Figure 6:
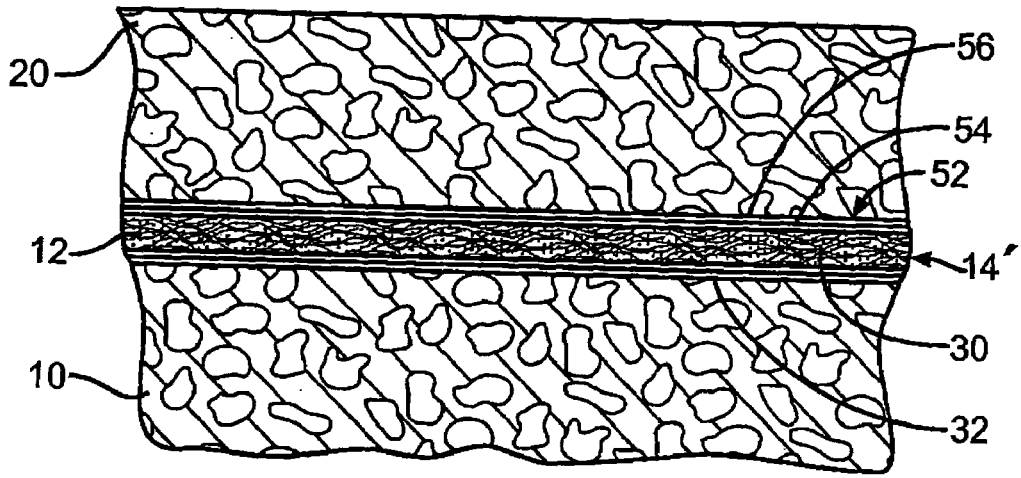
FIG. 6 is a cross-sectional view in elevation of a paved surface including a mat having a nonstick layer according to the invention.

In a further embodiment of the invention, a nonstick layer is applied to one of the mats described above. As shown in FIG. 6, the nonstick layer 52 includes a polymer layer 54, and a nonstick coating 56 on the upper surface of the polymer layer. The nonstick layer resists sticking to the tires of paving construction equipment that have been coated with asphalt tack during the paving operation, and it allows the bonding of the paved surface 10, the mat 14', and the upper layer 20 of paving material. To accomplish this, the nonstick coating and the polymer layer resist melting at typical tack layer 12 temperatures. However, once the upper layer 20 of paving material is applied, the higher temperature of the upper layer causes the melting of the nonstick layer 52, thereby allowing a firm bond to be formed between the paved surface 10, the mat 14', and the upper layer 20 of paving material. (For illustration purposes, the nonstick layer 52 is shown in FIG. 6 prior to melting.) The polymer layer of the nonstick layer consists of any type of polymer or mixture of polymers having the desired melting properties and solubility characteristics in asphalt. Preferably, the polymer has a melting point between about 200° F. (93° C.) and about 300° F. (149° C.), and more preferably between about 225° F. (107° C.) and about 250° F. (121° C.). Some examples of polymers that may be suitable include polyethylene, polypropylene, or a combination of polymers such as thermoplastic polyolefms (TPO's).

Any suitable non-stick coating material can be used on the upper surface of the polymer layer, such as Teflon) or silicone.

The nonstick layer is thick enough to resist damage from the paving operation, but thin enough to melt into the upper layer of paving material and not impede the function of the mat to which it is attached. Preferably, the overall thickness of the nonstick layer is in the range of about 0.005 inch (0.127 millimeter) to about 0.050 inch (1.27 millimeter), and more preferably about 0.015 inch (0.381 millimeter) to about 0.020 inch (0.508 millimeter). The thickness of the nonstick coating portion of the nonstick layer is typically about 0.001 inch (0.025 millimeter).

The nonstick layer can be in any suitable form, such as a sheet or strips. The nonstick layer can be adhered to the mat by any suitable method, such as by gluing, sewing, knitting, or other forms of adhesion and attachment.

As mentioned above, the mat of the invention can be used in the construction of a new paved surface, in the rejuvenation of an existing paved surface, or to repair cracks, potholes or other defects in an existing paved surface. When the defect is a crack in a paved surface, the mat with or without a tack layer may be applied over the crack without initial preparation of the crack, or alternatively the crack may be filled with an appropriate crack filler such as those meeting the requirements of ASTM D-3405 or D-1190 or other suitable material. When the defect is a pothole in the paved surface, typically the pothole is initially filled with a material conventionally used for filling potholes, such as an asphalt paving material. Then the mat with or without a tack layer is applied over the filled pothole. Badly broken or rough pavement may require milling or placement of a leveling course before application of the mat. Finally, a layer of paving material is applied over the mat and the defect. When the repair is completed, the mat forms a strong bond with the paved surface and holds the paved surface around the defect together. The mat may prevent water from penetrating into the defect from above and causing further damage.

Figure 7:
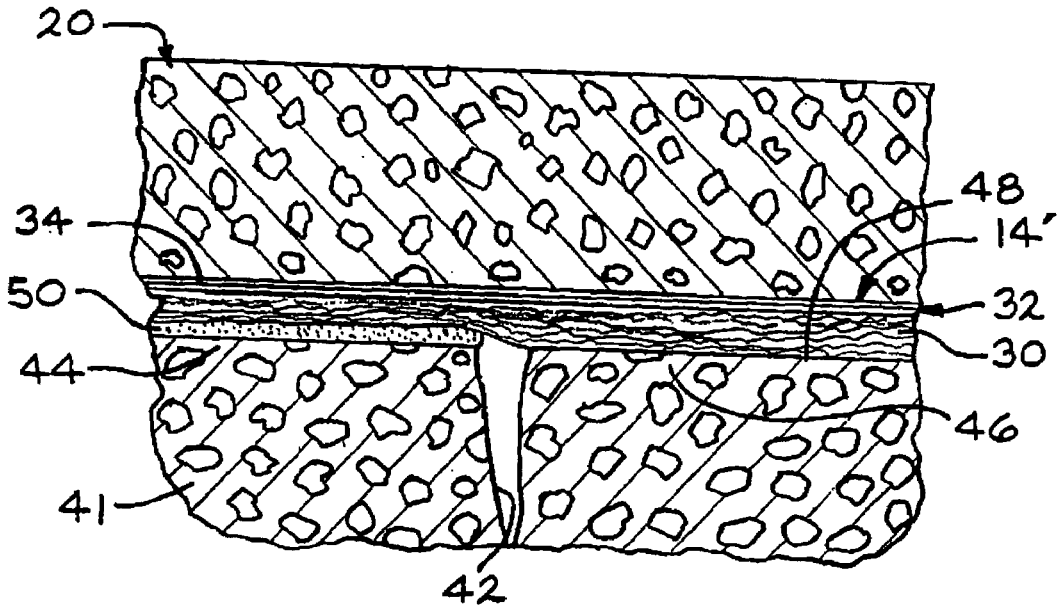
FIG. 7 is a cross-sectional view in elevation of a paved surface having a crack which is repaired using a two-layer mat according to the invention.

In another embodiment, the invention relates to a particular method of repairing a crack in a paved surface. FIG. 7 shows a paved surface 41 having a crack 42 which is repaired according to this method. The paved surface 41 includes a first surface portion 44 on one side of the crack (the left side as viewed in FIG. 7), and a second surface portion 46 on the opposite side of the crack (the right side as viewed in FIG. 7). In the illustrated embodiment, the first surface portion is adjacent a first longitudinal side of the crack and the second surface portion is adjacent a second longitudinal side of the crack.

In this repair method, a desired mat is applied over the crack 42. Any type of mat may be used, such as mat 14, 14', 14" or 14'" or another suitable mat. In this repair method it is preferred that the mat is saturated with asphalt before it is applied to a road surface. As shown in FIG. 7, the mat 14' is secured to the first surface portion 44 of the paved surface 41 on the one side of the crack, but the mat is left unsecured to the second surface portion 46 of the paved surface 41 on the opposite side of the crack.

Then, a layer of paving material 20 is applied over the mat 14'. Securing the mat to the paved surface on only one side of the crack reduces the occurrence of reflective cracking by leaving a slip plane or energy dissipation area 48 between the mat 14' and the second surface portion 46 of the paved surface. The slip plane 48 is defined as the area where a bottom surface of the mat 14' contacts the paved surface 41. As the paved surface 41 surrounding the crack 42 is caused to move over time, the slip plane 48 allows the second surface portion 46 to move relative to the mat 14' without the movement of the second surface portion 46 being reflected to the newly applied layer of paving material and thereby creating a crack in the paving material.

The mat can be secured to the paved surface on one side of the crack by any suitable method. In the embodiment shown in FIG. 7, an adhesive 50 is applied to the first surface portion 44 of the paved surface 41 adjacent the crack 42 thereby adhering the mat 14' to the first surface portion 44. Any suitable adhesive can be used, such as molten asphalt or a polymeric adhesive.

In another embodiment (not shown), the adhesive is first applied to the mat, and the mat having the adhesive is then applied to the paved surface. In another embodiment (not shown), the mat is secured to the paved surface by first applying a pressure sensitive adhesive to the mat, and then pressing the mat against the paved surface. In a further embodiment (not shown), the mat is secured to the paved surface by first applying a self-activated adhesive to the mat, and applying the mat to the paved surface in a manner which activates the adhesive. For example, the self-activated adhesive may be a heat-activated adhesive which is activated when the layer of heated paving material is applied over the mat. Alternatively, the mat may comprise other known materials adhered to a single side of the crack.

As described in the paper entitled "A study of grid reinforced asphalt to combat reflection cracking," by S. F. Brown et al., the crack-causing strain in an asphalt road surface is generally perpendicular or transverse to a crack formed in a road surface. Surprisingly, it has been discovered that by using the mat 14' to repair a crack, attaching the second layer 32 having the strands 34 parallel to the direction of vehicular travel, and positioning the strands 34 transverse to an elongated crack to be repaired, the occurrence of reflective cracking is substantially eliminated. As is known, cracks in road surfaces are often not elongated, are often irregularly shaped, and can extend in multiple directions. It has also been discovered that when the mat 14" and 14''', formed by attaching the second layers 36 and 40, respectively, to the first layer 30, is used to repair such an irregular crack, the occurrence of reflective cracking is substantially reduced.

The principle and mode of operation of this invention have been described in its preferred embodiments. However, it should be noted that this invention may be practiced otherwise than as specifically illustrated and described without departing from its scope. For example, while the method of the invention has been illustrated in terms of a new or rejuvenated paved surface, and repairing a crack in a paved surface, the mat can also be used for repairing other defects such as potholes in paved surfaces. The drawings show a particular type and size of mat, but other types and sizes of mat can also be used. The drawings also show particular types and amounts of liquefied asphalt and paving material, but it is recognized that other types and amounts of liquefied asphalt and paving material can be used in the invention.

What is claimed is:

1. A method of improving a paved surface comprising the steps of:

(a) applying a layer of liquefied asphalt on a surface;

(b) applying a mat comprising a nonwoven mat produced from a mixture of mineral fibers and polymer fibers, the fibers having a melting point above 330° F. (166° C.) the mat having a load-elongation behavior such that the mat achieves at least 90% of its ultimate load at an elongation not greater than 5% of the mat length in the direction of applied tensile stress, on the surface, the liquefied asphalt penetrating and soaking the mat; and (c) applying a layer of paving material over the mat.

2. A method according to claim 1 wherein the fibers have a melting point of at least about 350° F. (177° C.).

3. A method of improving a paved surface comprising the steps of:

(a) applying a layer of liquefied asphalt on a surface;

(b) applying a mat on the surface, the mat comprising a nonwoven mat produced from a mixture of mineral fibers and polymer fibers, the fibers having a melting point above 330° F. (166° C.) the mat having a load elongation behavior such that the mat achieves at least 90% of its ultimate load at an elongation not greater than 5% of the mat length in the direction of applied tensile stress, the liquefied asphalt penetrating and soaking the mat; and (c) applying a layer of paving material over the mat;

wherein the mat in step (b) has a load-elongation behavior such that the mat achieves at least 90% of its ultimate load at an elongation not greater than 5% of the mat length in the direction of applied tensile stress.

* * * * *